US011333430B2

(12) United States Patent
Rehage et al.

(10) Patent No.: US 11,333,430 B2
(45) Date of Patent: May 17, 2022

(54) STORAGE SHELF FOR A PIECE OF FURNITURE OR HOUSEHOLD APPLIANCE, PIECE OF FURNITURE AND HOUSEHOLD APPLIANCE

(71) Applicant: PAUL HETTICH GMBH & CO. KG, Kirchlengern (DE)

(72) Inventors: Daniel Rehage, Chemnitz (DE); Stefan Mertins, Bünde (DE); Reinhard Büscher, Bünde (DE); Eduard Arnst, Lemgo (DE); Andreas Matthes, Chemnitz (DE)

(73) Assignee: PAUL HETTICH GMBH & CO. KG, Kirchlengern (DE)

( * ) Notice: Subject to any disclaimer, the term of this patent is extended or adjusted under 35 U.S.C. 154(b) by 0 days.

(21) Appl. No.: 17/047,880

(22) PCT Filed: Apr. 4, 2019

(86) PCT No.: PCT/EP2019/058507
§ 371 (c)(1),
(2) Date: Oct. 15, 2020

(87) PCT Pub. No.: WO2019/201612
PCT Pub. Date: Oct. 24, 2019

(65) Prior Publication Data

US 2021/0156609 A1 May 27, 2021

(30) Foreign Application Priority Data

Apr. 16, 2018 (DE) ..... 10 2018 108 977.5

(51) Int. Cl.
*F25D 25/02* (2006.01)
*A47B 49/00* (2006.01)

(52) U.S. Cl.
CPC ..... *F25D 25/021* (2013.01); *F25D 25/027* (2013.01); *A47B 49/004* (2013.01)

(58) Field of Classification Search
CPC ..... F25D 25/021; F25D 25/027; A47B 46/00
(Continued)

(56) References Cited

U.S. PATENT DOCUMENTS 2,647,812 A 8/1953 Saunders
2,840,438 A * 6/1958 Verlosg ..... F25D 25/027 312/322

(Continued)

FOREIGN PATENT DOCUMENTS

DE 1198026 A 8/1965
DE 3809992 A1 10/1989

(Continued)

OTHER PUBLICATIONS

International Search Report dated May 13, 2019 in related/corresponding International Application No. PCT/EP2019/058507.

(Continued)

*Primary Examiner* — James O Hansen
(74) *Attorney, Agent, or Firm* — Patent Portfolio Builders PLLC

(57) ABSTRACT

A storage shelf for a piece of furniture or a household appliance includes a support plate stationarily arranged on a carcass of the piece of furniture or household appliance, and a storage tray that is positively driven relative to the support plate and can simultaneously be moved rotationally and translationally. Mutually opposed bearing surfaces of the support plate and the storage tray have respective at least substantially closed all-round grooves, in which rolling elements are guided, the bearing surfaces of the support plate and the storage tray having shaped elements that face the respective other bearing surface and that force an at least (Continued)

Figure 1:
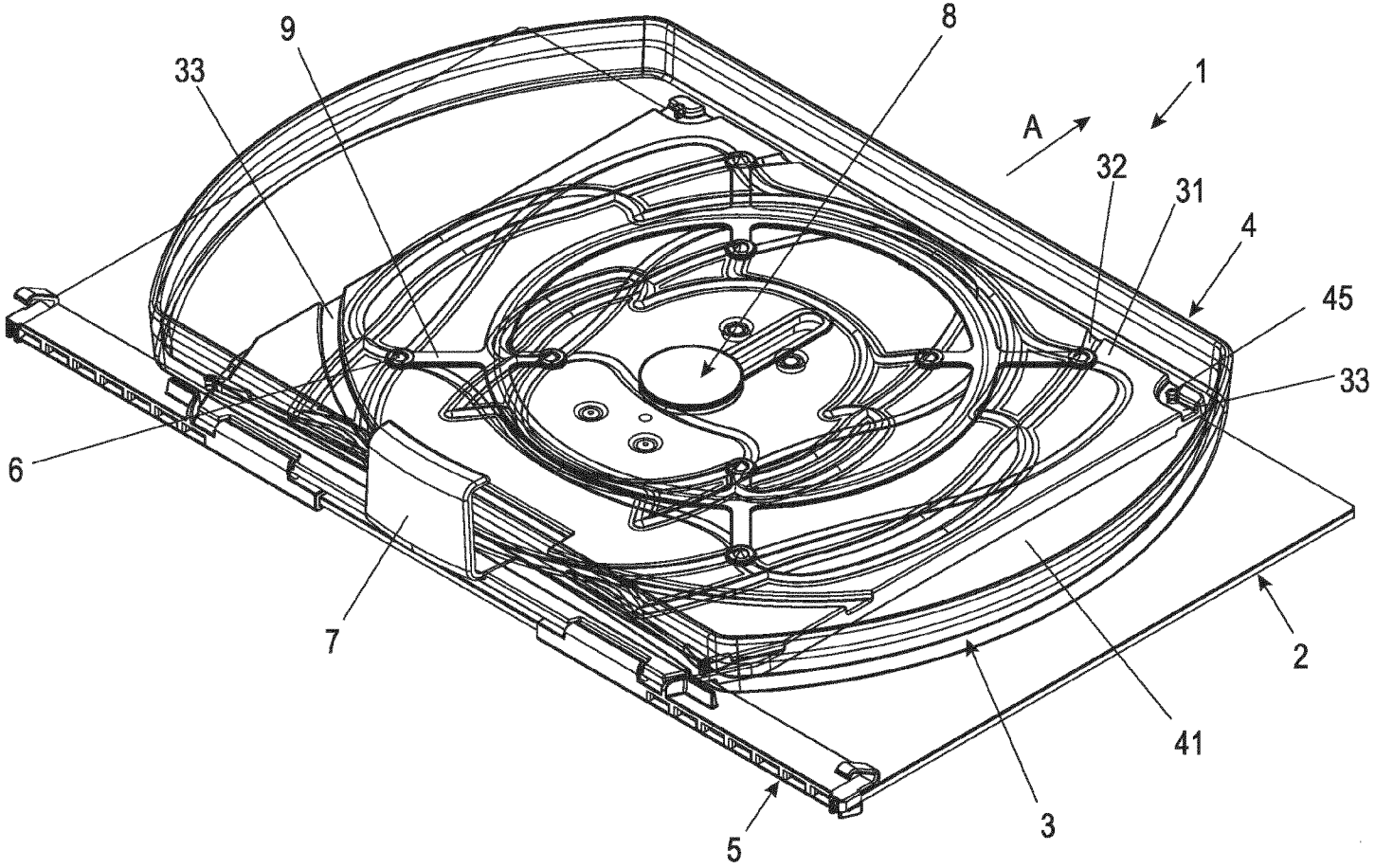

partly rotatory motion of the support tray in order to move the support tray relative to the support plate from an initial position into a charging/discharging position.

11 Claims, 15 Drawing Sheets

(58) Field of Classification Search
USPC ..... 312/294, 408, 238
See application file for complete search history.

(56) References Cited

U.S. PATENT DOCUMENTS

| | | | | |
|---|---|---|---|---|
| 2,936,205 | A * | 5/1960 | Clark | F25D 25/027 312/302 |
| 3,107,959 | A * | 10/1963 | Maxwell, Jr. | F25D 25/02 312/322 |
| 4,582,372 | A | 4/1986 | Cooper | |
| 7,147,445 | B2 * | 12/2006 | Krayer | F16N 13/20 418/150 |
| 9,022,495 | B1 * | 5/2015 | Conner, Sr. | F25D 25/027 312/408 |
| 2002/0117943 | A1 | 8/2002 | Gerkey et al. | |
| 2004/0177641 | A1 * | 9/2004 | Kim | A47B 49/004 62/441 |
| 2020/0018349 | A1 | 1/2020 | Rehage et al. | |

FOREIGN PATENT DOCUMENTS

| | | | |
|---|---|---|---|
| DE | 4216765 | A1 | 12/1992 |
| DE | 102017106170 | A1 | 9/2018 |
| JP | 2012149838 | A | 8/2012 |
| KR | 19980074208 | A | 11/1998 |
| WO | 8704325 | A1 | 7/1987 |

OTHER PUBLICATIONS

Search Report created dated Apr. 2, 2019 in related/corresponding DE Application No. 10 2018 108 977.5.
Written Opinion dated May 13, 2019 in related/corresponding International Application No. PCT/EP2019/058507.

* cited by examiner

STORAGE SHELF FOR A PIECE OF FURNITURE OR HOUSEHOLD APPLIANCE, PIECE OF FURNITURE AND HOUSEHOLD APPLIANCE

BACKGROUND AND SUMMARY OF THE INVENTION

Exemplary embodiments of the present invention relate to a storage shelf for a piece of furniture or household appliance and a piece of furniture or household appliance.

A storage shelf, in which a turntable is installed directly in a base plate of the storage shelf, is known from DE 42 16 765 A1, for example.

DE 10 2017 106 170 A1 discloses a storage tray that is positively guided relative to a support plate and can be moved both rotationally and translationally, allowing access from otherwise difficult to reach areas in a storage space of a piece of furniture or household appliance such as a refrigerator or freezer.

A disadvantage of these storage shelves has been shown to be that the storage shelf can move automatically relative to the support plate, especially in case of uneven loading or not exactly horizontal positioning of the plate, which can also be caused by an imprecise positioning of the carcass of the furniture or household appliance.

Furthermore, when a tractive force is applied in the middle of a front edge of the storage tray and therefore does not exert any torque on the tray, the rolling elements between the support plate and the storage tray may be misaligned, so that subsequent rotary movement is blocked due to this misalignment.

Exemplary embodiments of the present invention are directed to further develop the storage shelf in such a way that blocking of the rolling elements due to operating errors is effectively prevented.

Exemplary embodiments of the present invention are further directed to further develop the storage tray in such a way that an automatic extension of the storage tray relative to the support plate is prevented.

The storage shelf according to the invention has a support plate stationarily arranged on a carcass of the piece of furniture or household appliance and a storage tray that is positively driven relative to the support plate and can simultaneously be moved in one pull-out direction both rotationally and translationally.

Bearing surfaces of the support plate and the storage shelf facing each other have respective at least predominantly closed, all-around rolling element grooves in which rolling elements are guided.

The bearing surfaces of the support plate and the shelf have respective shaped elements facing the other bearing surface, which force an at least proportionate rotational movement of the storage shelf relative to the support plate from an initial position towards a loading and unloading position.

Such shaped elements can be easily attached or formed to the bearing surfaces of the support plate and storage tray.

The arrangement of these shaped elements on the bearing surfaces of the support plate and the storage tray easily prevents the rotatably mounted storage tray from being pulled out by centrally acting pulling, so that a person who wants to move the storage tray out of the initial position towards a loading and unloading position is induced to continue to act laterally on the storage tray in order to exert a torque on the storage tray and thus cause a simultaneous rotational movement together with a translational movement of the storage tray.

According to an advantageous embodiment variant of the invention, shaped elements in the form of pins protrude from one of the bearing surfaces, which in the initial position of the storage tray are positioned in the pull-out direction behind shaped elements in the form of cams which protrude from the other of the bearing surfaces.

Such shaped elements, designed as cams or pins, enable reliable operation of the storage shelf and can be easily formed or attached to the bearing surfaces.

The cams are preferably designed with two legs according to another preferred embodiment variant, wherein a first cam leg is aligned in the plane of the first bearing surface at an angle to a second cam leg.

In order to prevent the storage tray from extending automatically, the storage shelf has, as described above, a support plate, a storage tray, which can be moved relative to the latter and whose bearing surfaces facing each other also have, as described above, rolling element grooves in which rolling elements are guided, wherein the bearing surfaces of the support plate and of the storage tray have respective latching elements facing the respective other bearing surface, which latching elements engage in each other at least in the initial position of the support plate and of the storage tray.

With such latching elements provided in the bearing surfaces of the support plate and the storage tray, the user can haptically recognize whether the storage tray has reached its initial position.

It is particularly advantageous if the latching elements are arranged between the bearing surfaces of the storage tray and the support plate in such a way that they are invisible from the outside. In this way they are optimally protected against contamination and damage.

To move the storage tray out of this initial position, a certain minimum force is required to overcome the latching and thus release the movement of the storage tray relative to the support plate.

According to an advantageous embodiment variant, the latching elements of the first of the bearing surfaces are designed as spherical caps protruding from it in the direction of the second of the bearing surfaces and the latching elements of the second of the bearing surfaces are designed as beads.

This allows a reliable and sufficient latching of the storage tray relative to the support plate, which prevents the storage tray from extending automatically and at the same time requires only a small manual force to release the storage tray from the latching with the support plate.

According to another preferred embodiment variant, the support plate is detachably held to the carcass of the furniture or household appliance by at least one adapter.

According to another advantageous embodiment variant, the storage shelf has a base plate which can be fixed to the carcass of the furniture or household appliance by means of the adapter designed as a base plate holder. The support plate rests on the base plate.

The storage shelf according to the invention can preferably be used in a piece of furniture or a household appliance, especially in a refrigerator or freezer. For this purpose, the piece of furniture or household appliance has a carcass to accommodate the storage shelf.

BRIEF DESCRIPTION OF THE DRAWING FIGURES

Figure 2:
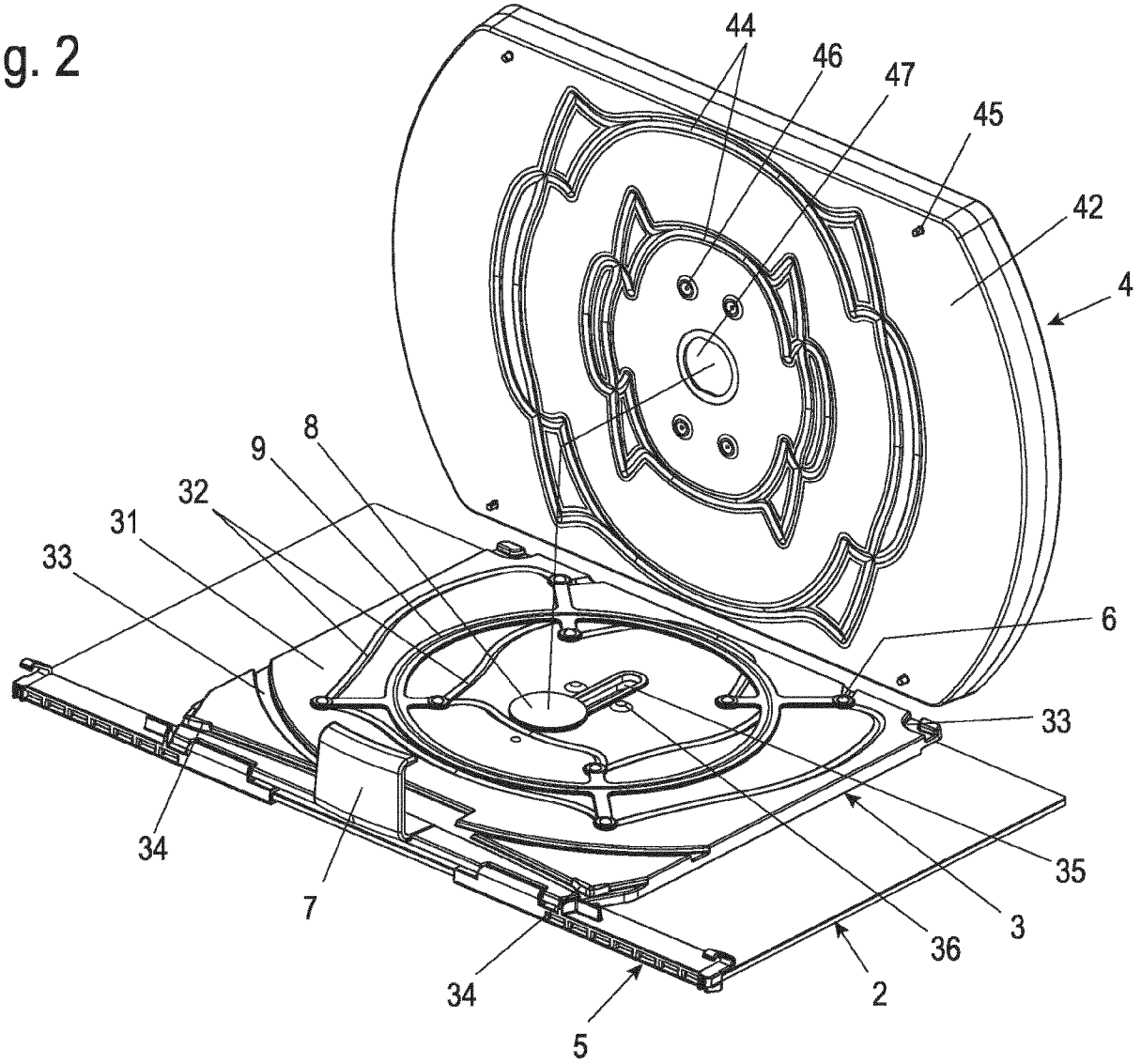
Figure 3:
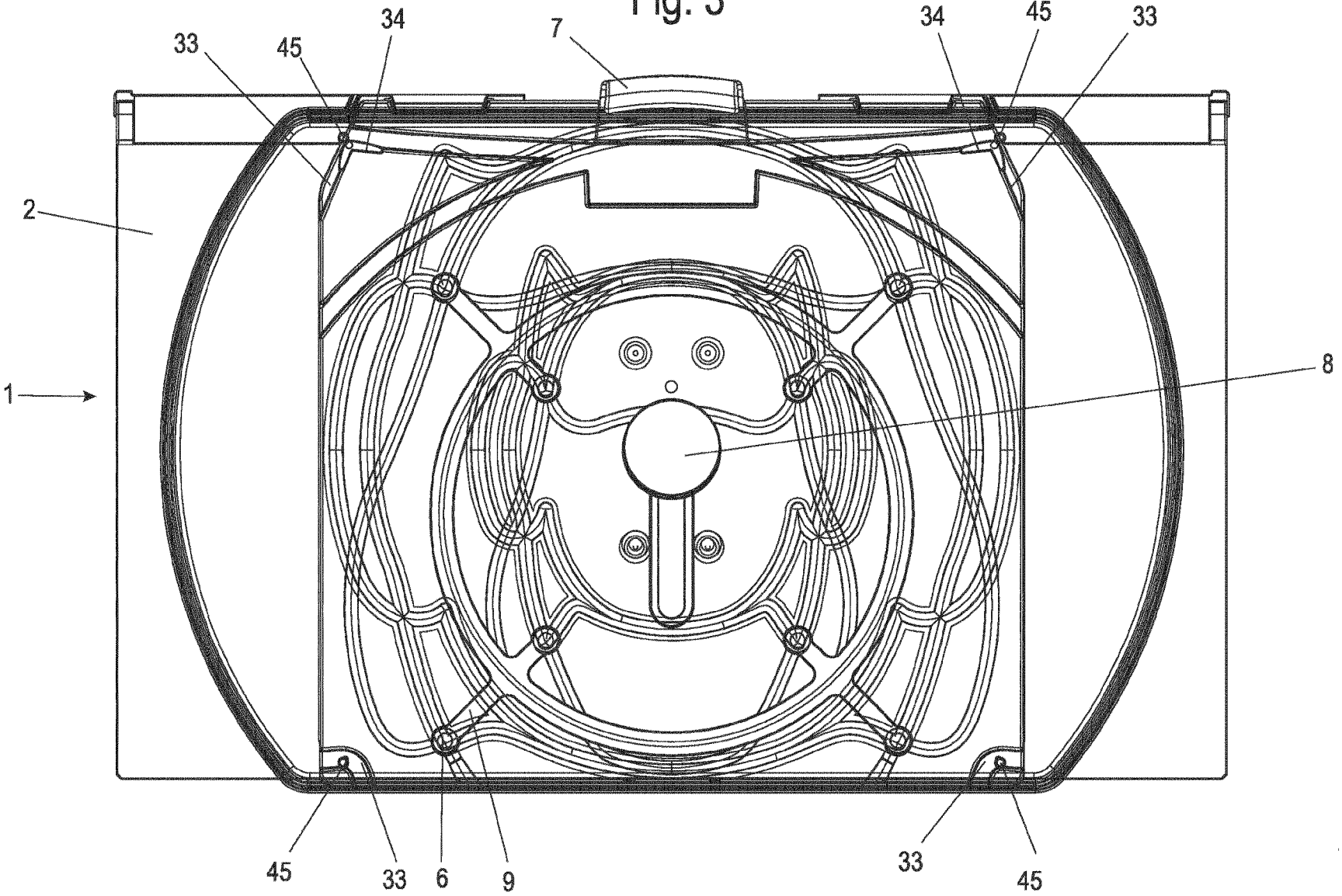
Figure 4:
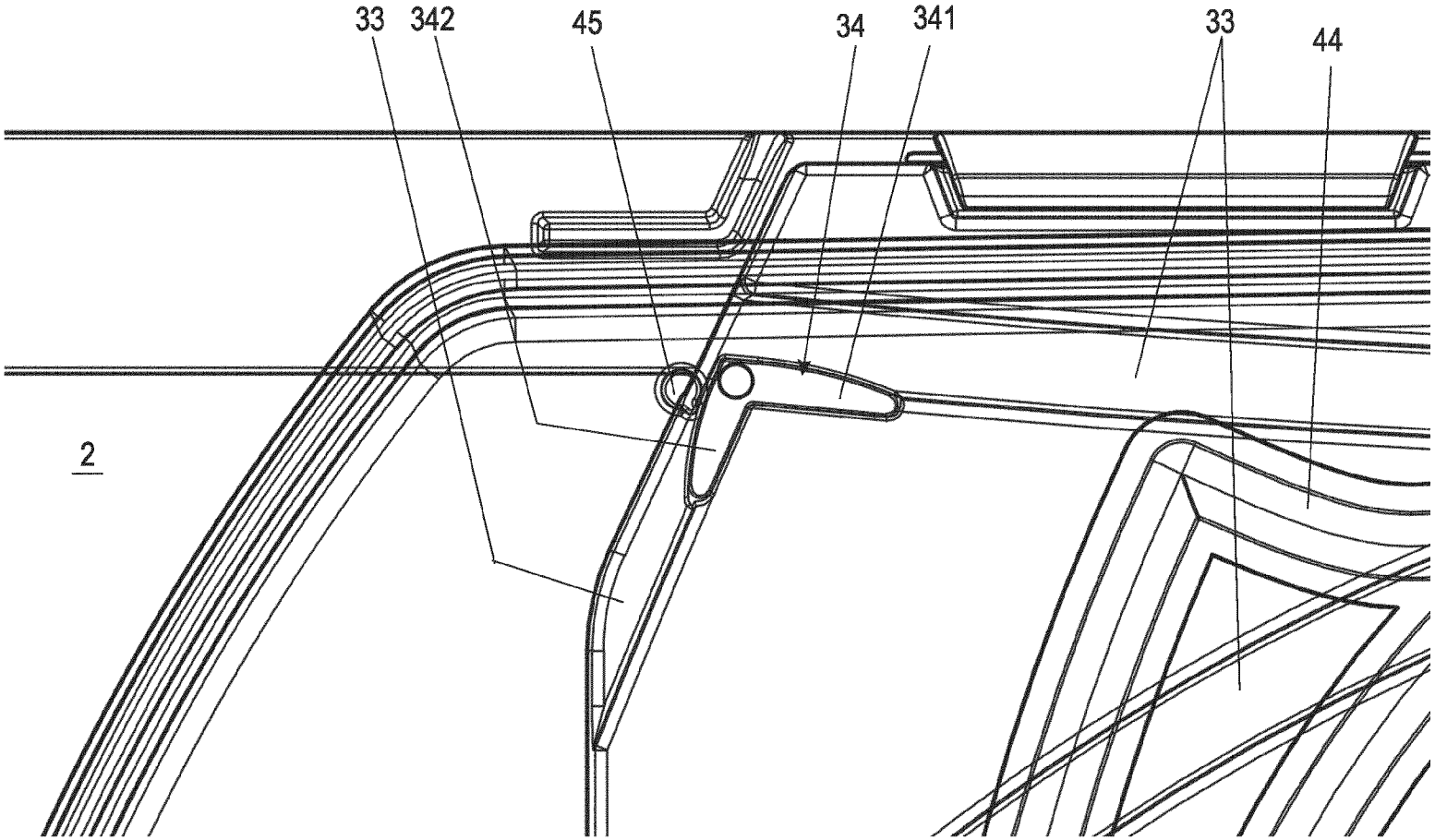
Figure 5:
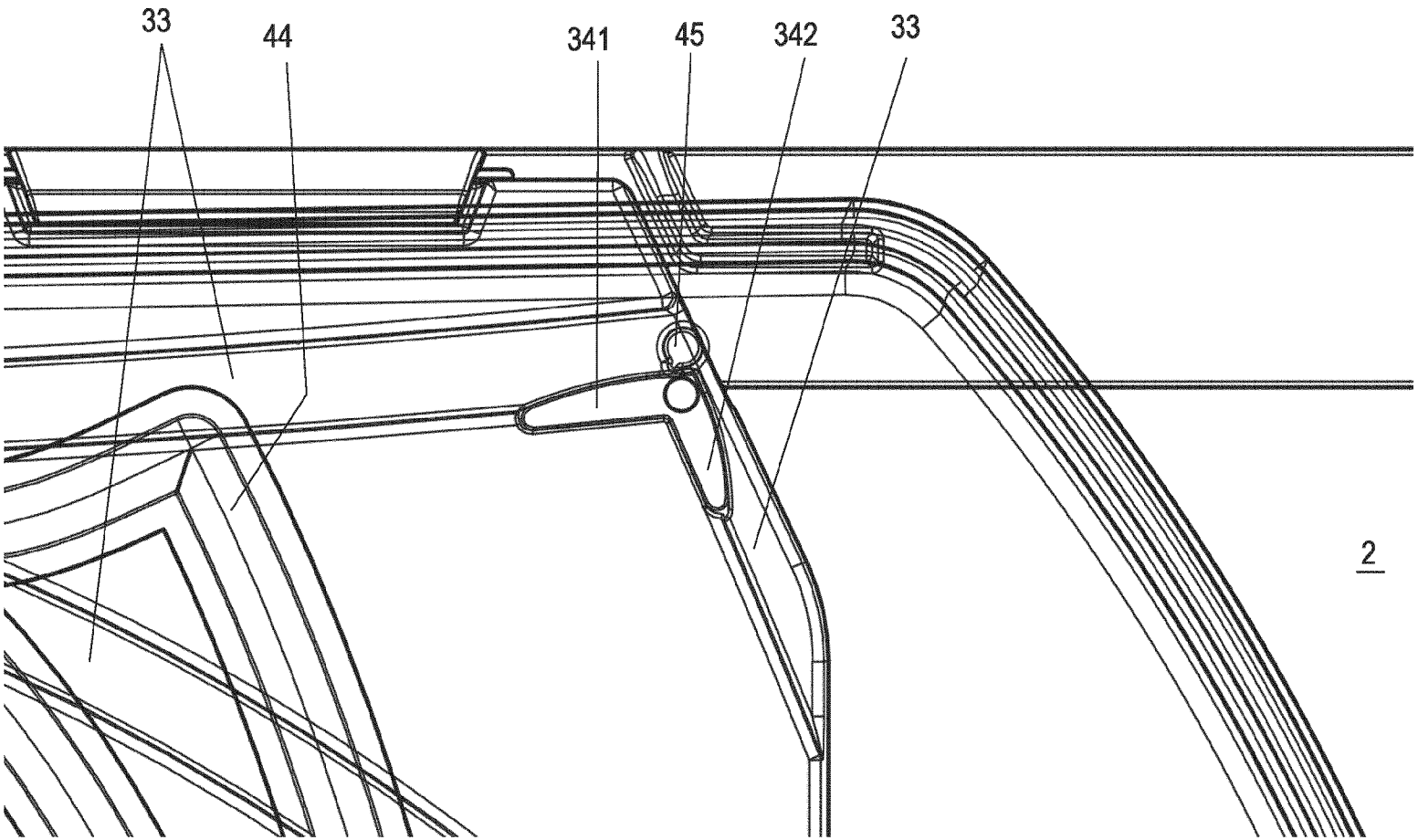
Figure 6:
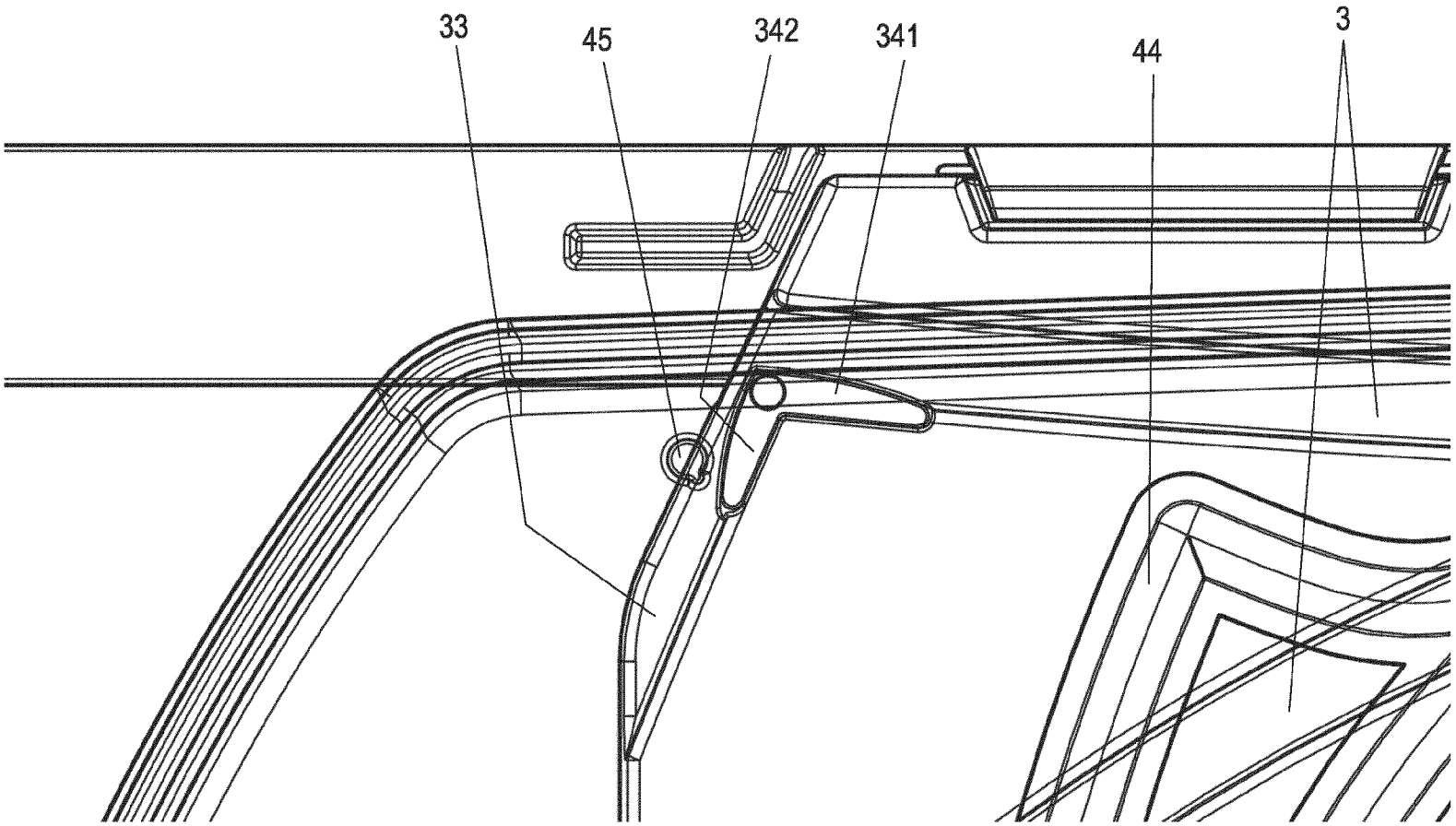
Figure 7:
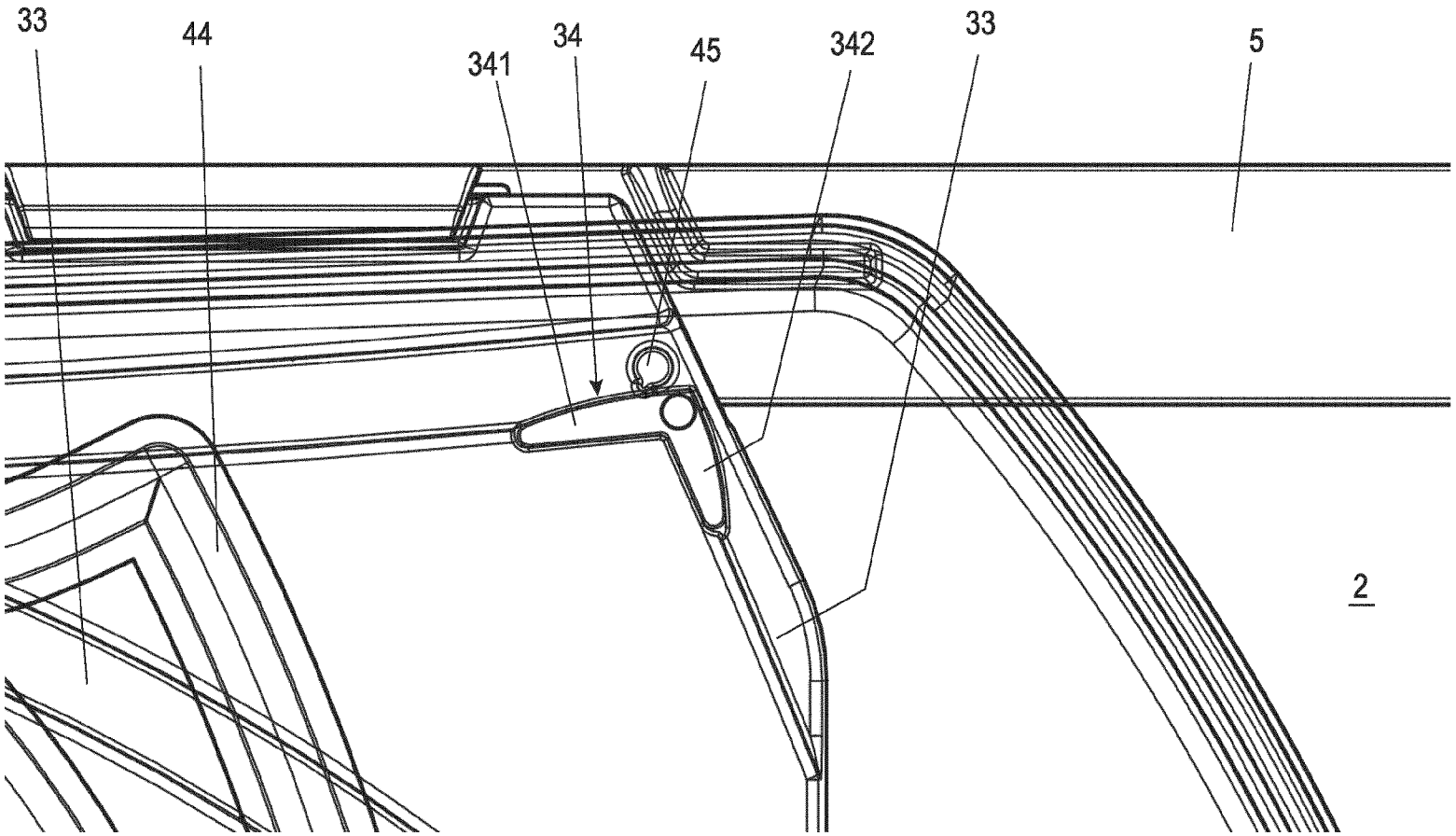
Figure 8:
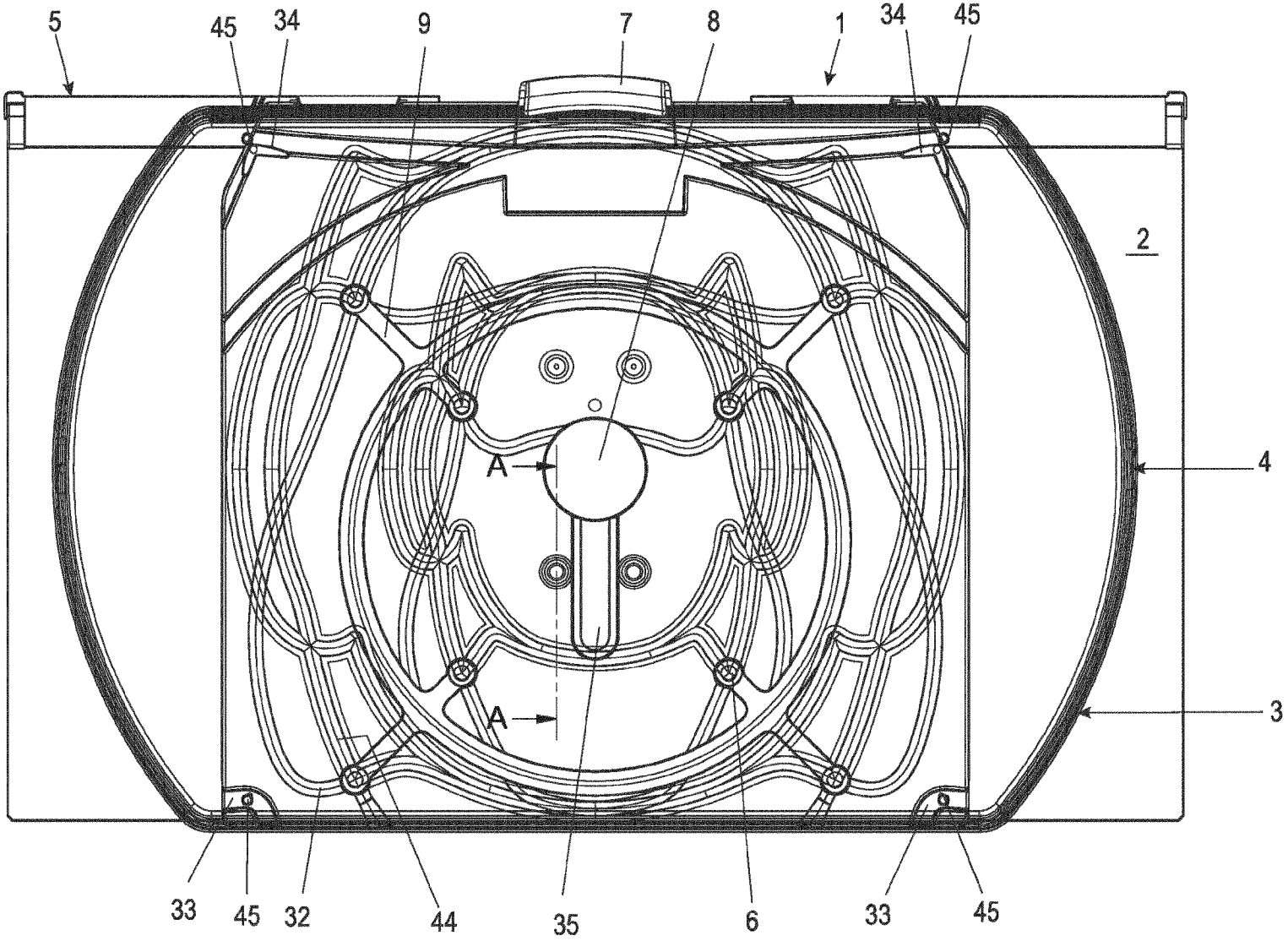
Figure 9:
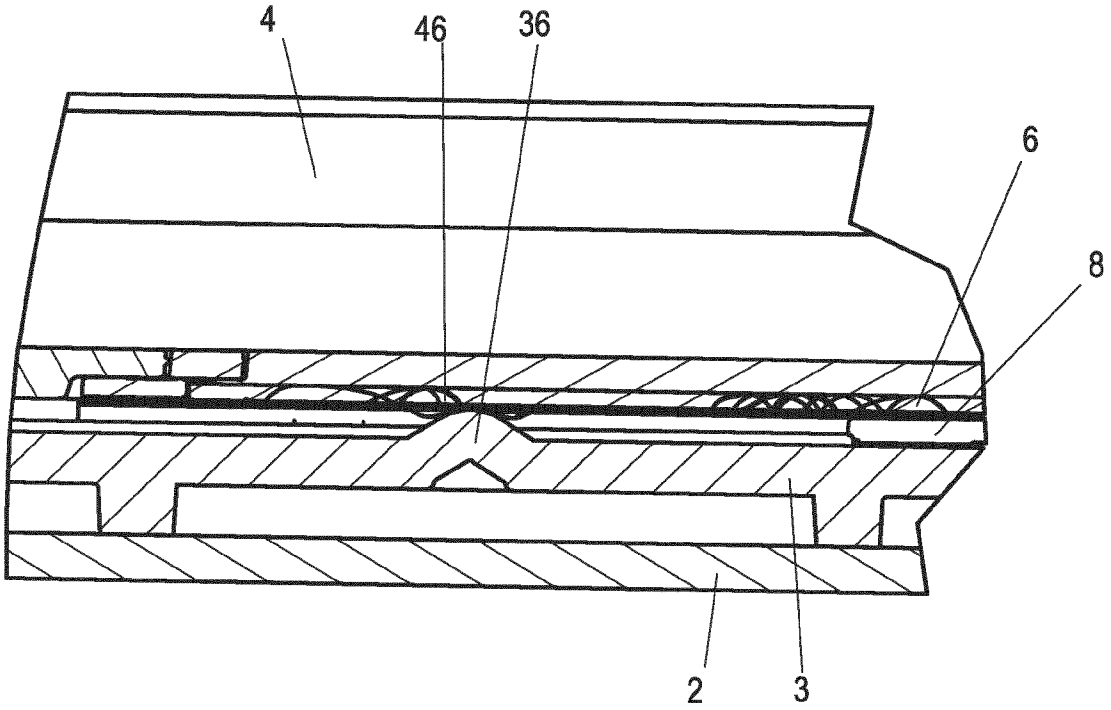
Figure 10:
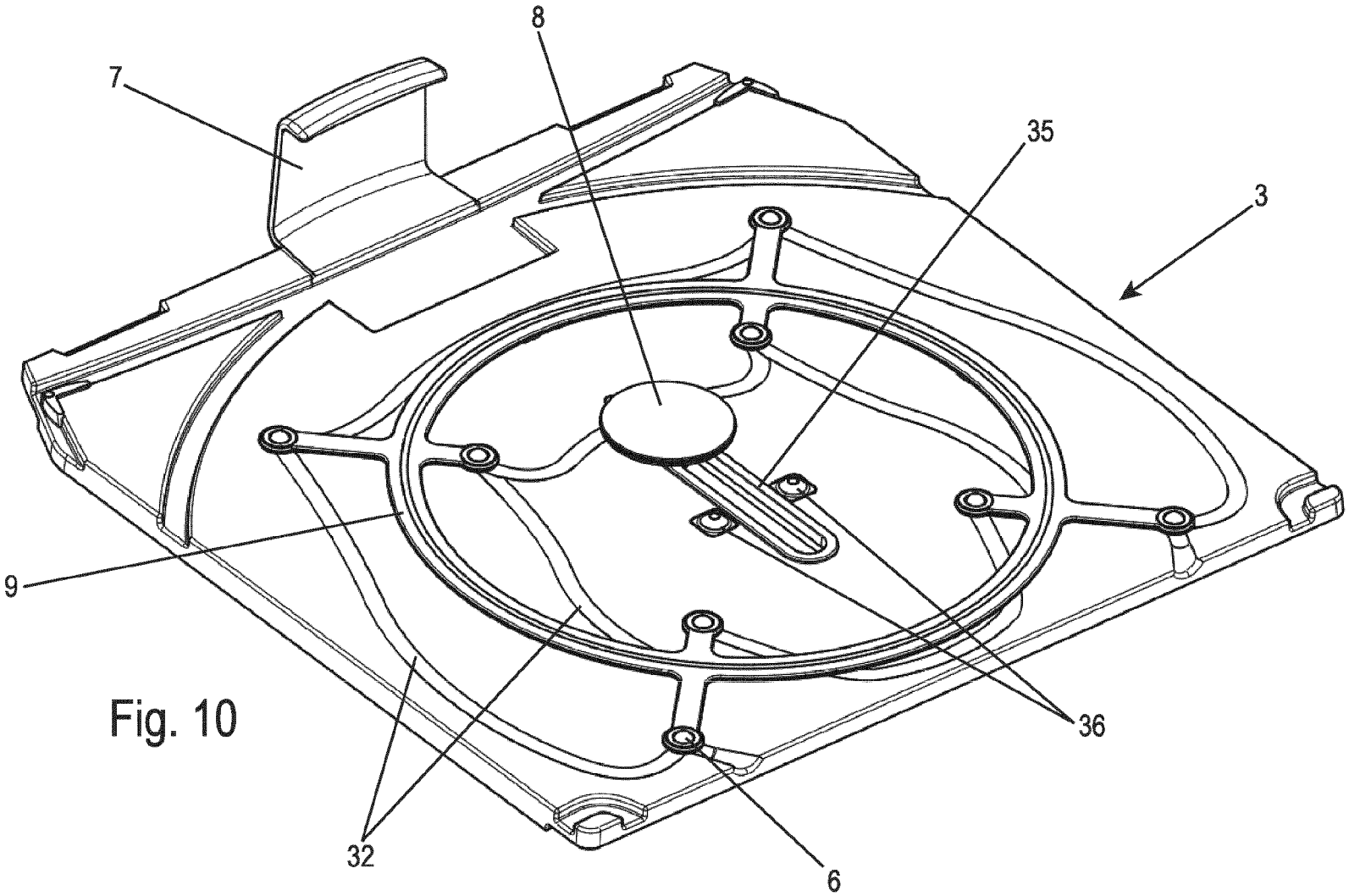
Figure 11:
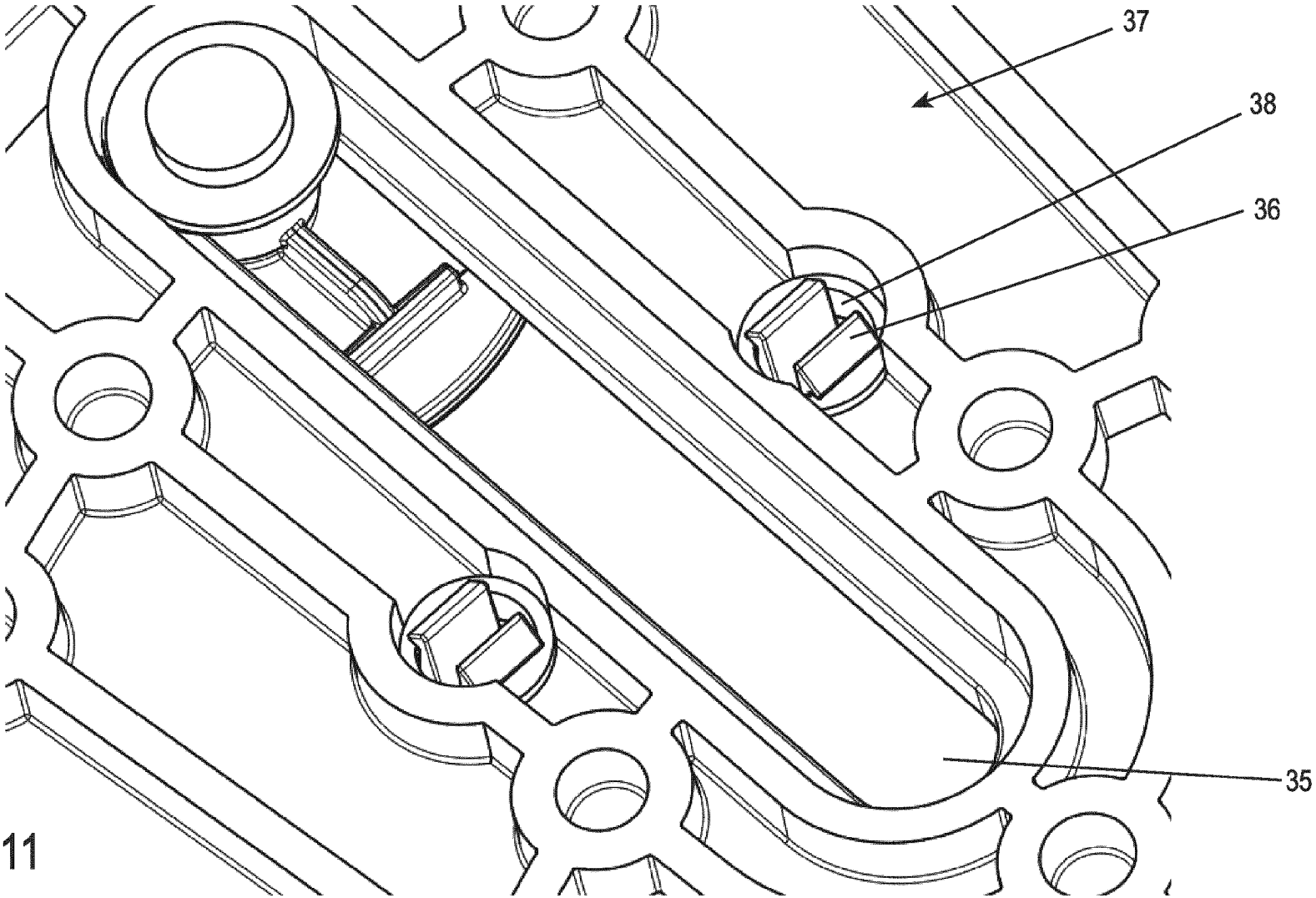
Figure 12:
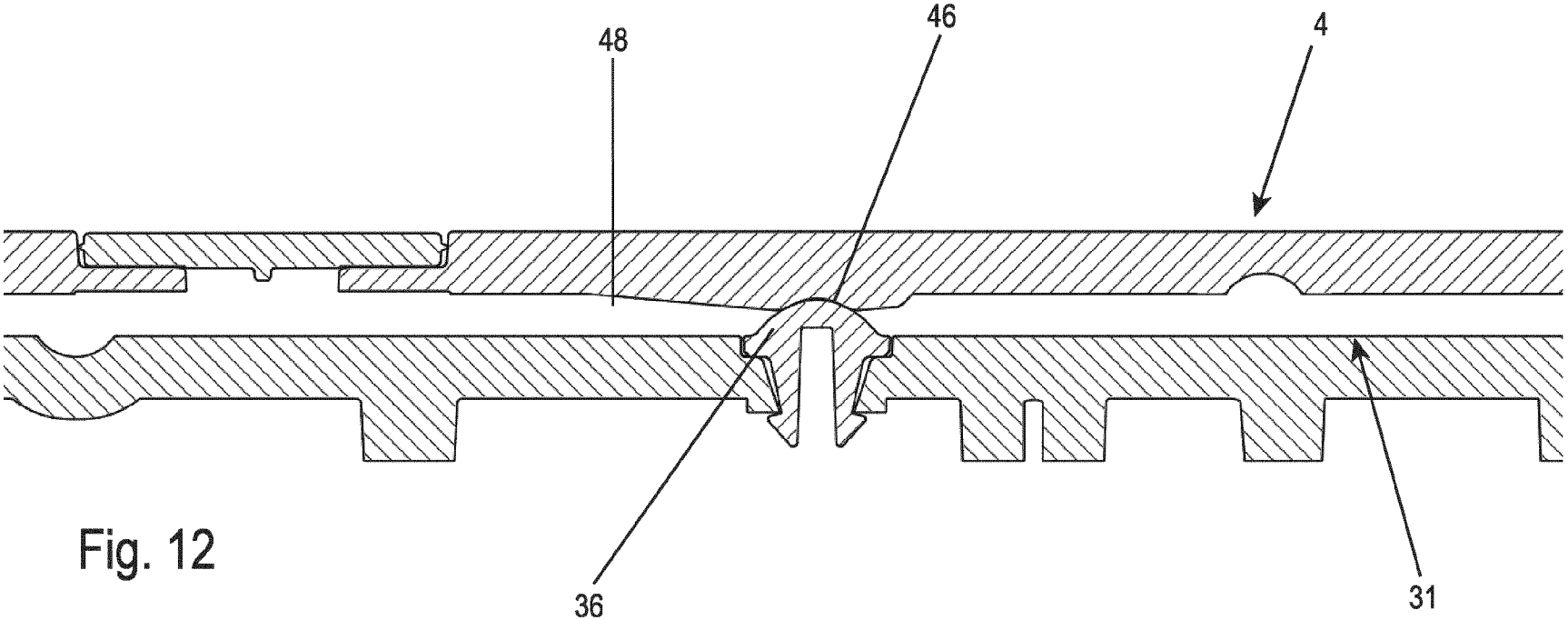
Figure 13:
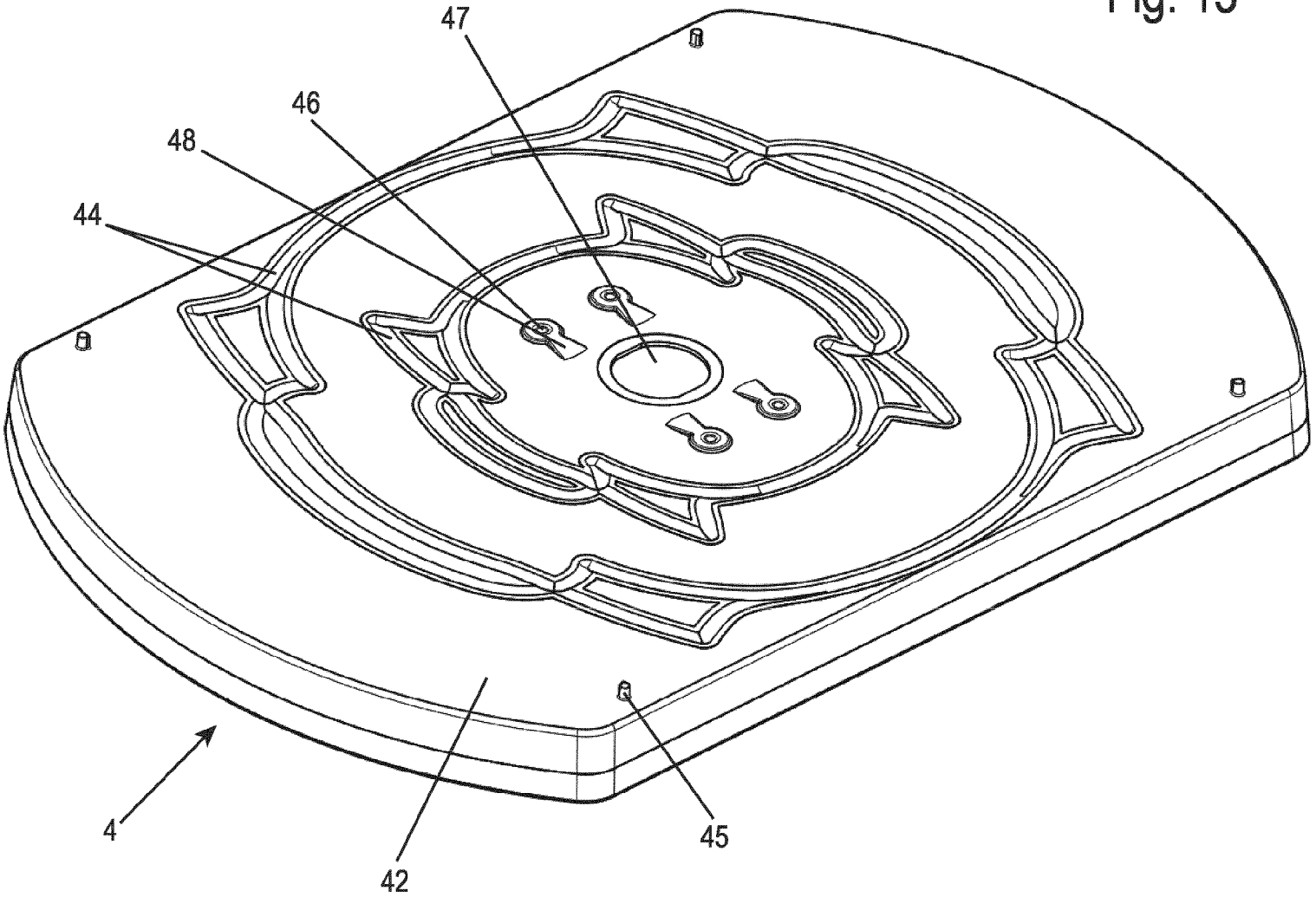
Figure 14:
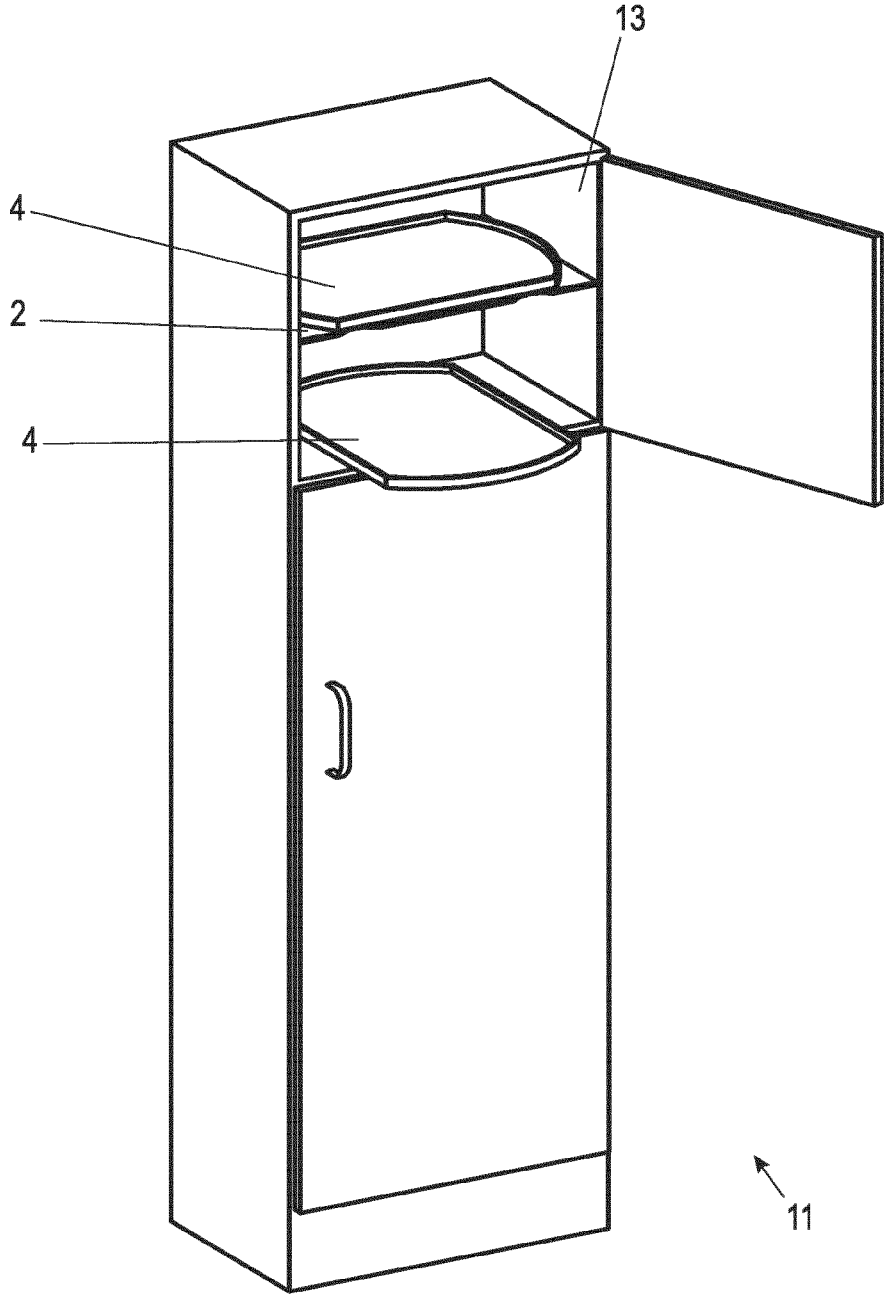
Figure 15:
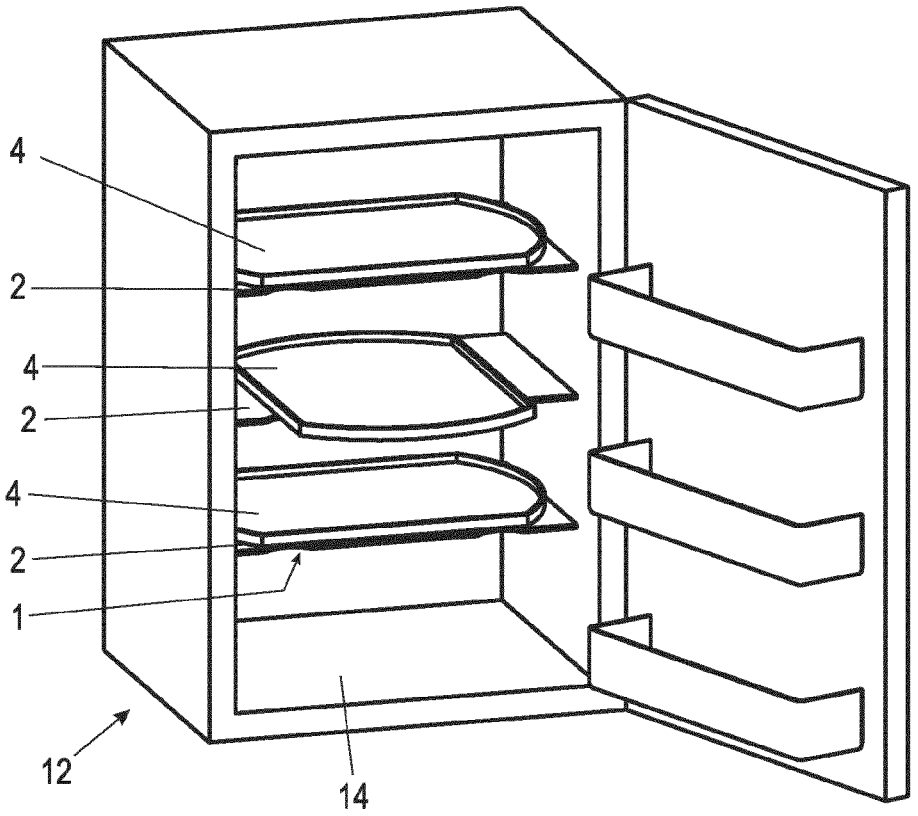

In the following, preferred embodiment variants of the invention are explained in more detail on the basis of the enclosed drawings, wherein:

FIG. 1 shows a perspective isometric representation of an embodiment variant of a storage shelf according to the invention, FIG. 2 shows a perspective view of the storage shelf with the storage tray lifted upwards to show the bearing surfaces of the support plate and the storage tray, FIG. 3 shows an isometric top view of the storage shelf in its initial position, FIGS. 4 and 5 show a detailed view of the illustration shown in FIG. 3 with the storage tray rotated counterclockwise by 1° relative to the support plate, FIGS. 6 and 7 show Illustrations corresponding to FIGS. 4 and 5 with the storage tray rotated counterclockwise by 2° relative to the support plate, FIG. 8 shows an isometric top view of the storage shelf in the initial position with the sectional plane drawn in, FIG. 9 shows a sectional view of the sectional plane marked A in FIG. 8 to display the latching elements, FIG. 10 shows a perspective view of an alternative embodiment variant of the storage shelf to show mountable latching elements, FIG. 11 shows a perspective view of the bottom side of the storage shelf as shown in FIG. 10, FIG. 12 shows a sectional view of the storage shelf shown in FIGS. 10 and 13 and of the storage tray resting on this storage shelf to illustrate the latching elements, FIG. 13 shows a perspective view of the alternative embodiment variant of the storage tray as shown in FIG. 12, FIG. 14 shows a piece of furniture with storage shelves according to the invention and FIG. 15 shows a household appliance with storage shelves according to the invention.

DETAILED DESCRIPTION

In the following figure description, terms such as top, bottom, left, right, front, back, etc. refer exclusively to the exemplary representation and position of the storage shelf, base plate, support plate, storage tray, base plate holder and the like selected in the respective figures. These terms are not to be understood in a restrictive way, i.e., these references may change due to different working positions or mirror-symmetrical design or the like.

In FIG. 1, the reference numeral 1 indicates an embodiment variant of a storage shelf.

The storage shelf 1 has a base plate 2, which can be fixed stationarily to a carcass 13, 14 of a piece of furniture 11 or household appliance 12 (shown as an example in FIGS. 14 and 15) and a support plate 3, which is arranged on the base plate 2.

A storage tray 4, which can be moved both rotationally and translationally simultaneously, rests on said support plate 3.

For forced simultaneous rotary and translatory movement or prevention of an exclusively linear movement in a pull-out direction A of the storage tray 4, facing bearing surfaces 31, 42 of the support plate 3 and the storage tray 4, as shown in FIG. 2, have respective at least predominantly closed, all-around running grooves 32, 44, in which rolling elements 6 are guided. Balls are especially used in this case as rolling elements 6.

The support plate 3 is detachably attached to the base plate 2 by means of an adapter designed as a base plate holder 5, as shown in FIGS. 1 to 3. The base plate holder 5 is attached to the carcass 13, 14 of the piece of furniture 11 or household appliance 12 in the conventional manner, which is not shown here in closer detail.

It is also conceivable to fix the support plate 3 itself to such an adapter in such a way that the base plate 2 could also be omitted in an alternative variant of the storage shelf 1.

For the design of the rolling element grooves 32, 44 in the mutually facing bearing surfaces 31, 42 of the support plate 3 and the storage tray 4, explicit reference is hereby made to DE 10 2017 106 170 A1, in which the rolling element grooves are designated as running grooves.

The rolling element grooves 32, 44 are arranged for positively guided simultaneous rotational and translational movement of the storage tray 4 in such a way that two partially overlapping inner rolling element grooves 44 are introduced into the bearing surface 42 of the storage tray 4 and two likewise partially overlapping outer rolling element grooves 44 are inserted into the bearing surface 42 of the storage tray 4. All these rolling element grooves 44 are designed as closed all-around rolling element grooves.

The bearing surface 31 of the support plate 3 also has inner and outer rolling element grooves 32. The inner rolling element groove of the support plate 3 is designed as a closed, all-around rolling element groove. The outer rolling element groove is open towards a front side of the storage shelf 1.

The rolling elements 6 are mounted in a rolling element cage 9. In the embodiment variants shown here, the rolling element cage 9 is designed in the form of a circular ring with four arms extending radially outwards from the circular ring, with a further respective rolling element 6 being accommodated at each of the free ends.

The rolling element grooves 32, 44 are shaped in such a way that, when force is applied to the storage tray 4 in the horizontal direction, the storage tray 4 can be moved from an initial position, as shown in FIGS. 1 and 3, relative to the support plate 3 towards a loading and unloading position in which the storage tray 4 is not only rotated by 90° or 180°, but is also displaced by a predetermined distance in the pull-out direction A to facilitate loading and unloading.

The movement from this loading and unloading position back to the initial position is just as easily effected by exerting force in a horizontal direction in the closing direction, i.e., against the pull-out direction A, in which the storage tray 4 is moved further into the closing position either while maintaining the initial direction of rotation, or by reversing the direction of rotation.

To effect a simultaneous rotational and translational movement of the storage tray 4, it is necessary to have the force applied to the storage tray 4 in the horizontal direction not centered on the front side of the storage tray 4, but spaced from the center of the front side, in order to exert a torque on the storage tray 4 about an axis perpendicular to the support plate 3.

In order to prevent the rolling elements 6 from lifting out of the rolling element grooves 32, 44 in the event of a central attack, the bearing surfaces 31, 42 of the support plate 3 and the storage tray 4 have respective shaped elements facing the respective other bearing surface 42, 31, which force an at least proportionate rotational movement of the storage tray 4 relative to the support plate 3 from a pull-out position towards a loading and unloading position.

As can be seen clearly in FIG. 2, for example, there are shaped elements protruding from the bearing surface 42 in the form of pins 45, which are positioned, in the initial position of storage tray 4, in the pull-out direction A behind shaped elements in the form of cams 34, which protrude from the bearing surface 31 of the support plate 3, as can be seen in FIGS. 1 and 3. There are four pins 45 as an example. In this exemplary embodiment, the pins 45 are located in the four edge areas of the storage tray 4.

The cams 34 are arranged, especially formed, in the corner areas of the support plate 3 near the rear edge connected to the base plate holder 5.

The cams 34 are preferably designed with two legs, wherein a first cam leg 341 is oriented in the plane of the first bearing surface 31 at an angle, in particular at an obtuse angle, to a second cam leg 342, as shown for example in FIGS. 4 to 7. It is also conceivable that the cams 34 are curved, especially shaped in the form of a circular arc.

The second cam legs 342 at the right and left rear edge of the support plate 3 are aligned to each other in such a way that the pins 45 protruding from the storage tray 4 prevent a pure translational movement in pull-out direction A, as shown in FIG. 3.

Simultaneous rotation and translation, on the other hand, is possible, as shown in FIGS. 4 to 7. FIGS. 4 and 5 show details of the positions of the rear pins 45 relative to the cams 34 with the storage tray 4 pivoted 1° to the left.

As shown in FIG. 4, the pin 45 of the rear left corner of the storage tray 4 (as shown in FIG. 3) is moved from a position behind the first cam leg 341 to a position to the side of the second cam leg 342.

In order to prevent the pins 45 from resting on the bearing surface 31 of the support plate 3, the bearing surface 31 of the support plate 3 has additional guide grooves 33, which are embedded in the bearing surface 31 of the support plate 3 in accordance with the arrangement of the pins 45 on the bearing surface 42 of the storage tray 4.

FIG. 5 also shows the position of the storage tray 4 pivoted 1° to the left relative to the support plate 3 using the position of the rear right corner of the support plate 3, in which the pin 45 can be moved further to the left along the first cam leg 341.

FIGS. 6 and 7 show a representation corresponding to FIGS. 4 and 5 with the storage tray 4 pivoted by 2° relative to the support plate 3.

The pin 45 of the rear left corner of the storage tray 4 has moved along the second cam leg 342 towards its free end, while the pin 45 in the rear right corner of the storage tray 4 has moved only slightly further towards the free end of the first cam leg 341 of the rear right cam 34.

As shown in FIGS. 2 and 3, the front edge of storage tray 4 is also provided with pins 45 which, in the initial position of storage tray 4, protrude into guide grooves 33 in the area of the front corners.

These guide grooves 33 are also shaped in such a way that a pure translational movement in pull-out direction A is prevented by abutting the front pins 45 against the lateral edges of the guide grooves 33.

To prevent the storage tray 4 from tilting about a tilting axis parallel to the storage tray surface 41 of the storage tray 4, an anti-tilting element 7 is arranged on the support plate 3, preferably in the middle of the rear side edge of the support plate 3. The anti-tilting element 7 is shaped in such a way that it overlaps an upper edge of the storage tray 4.

The axial fixing of the support plate 3 with the storage tray 4 is done by a fixing device 8, as shown in FIGS. 1 to 3.

This fixing device 8 essentially consists of a screw protruding through a slot 35 in the support plate 3 extending in pull-out direction A, which is secured with a slide ring and a nut on the underside of the support plate 3 remote from the bearing surface 31, and is secured on the storage tray surface 41 remote from the bearing surface 42 of the storage tray 4 by a cap which covers a fastening receptacle 47 through which the screw of the fixing device 8 extends.

As further shown in FIGS. 1 to 3, the bearing surfaces 31, 42 of support plate 3 and storage tray 4 each have latching elements facing the respective other bearing surface 42, 31, which at least in the initial position of support plate 3 engage with each other at storage tray 4.

In the embodiment variant shown here, these latching elements are designed as spherical caps 36 and beads 46, with the spherical caps 36 protruding from the bearing surface 31 of the support plate 3 in the direction of the bearing surface 42 of the storage tray 4 and the beads 46 being recessed in the bearing surface 42 of the storage tray 4, as can be seen in particular in FIG. 9, a section through a sectional plane marked A-A in FIG. 8.

Conversely, recessed beads may also be formed on the bearing surface 31 of the support plate 3 and raised spherical caps on the bearing surface 42 of the storage tray 4.

Instead of the spherical caps 36 and beads 46 shown here as latching elements, it is also conceivable to arrange magnetic closers, spring bolts, spring-loaded balls or spring-loaded projections on the bearing surfaces 31, 42 of the support plate 3 and/or the storage tray 4.

Instead of beads, the mating elements can also be projections, behind which the mating elements snap into place, or recesses.

In this exemplary embodiment, the latching elements are arranged between the storage areas 42, 31 of the storage tray 4 and the support plate 3 in such a way that they are invisible from the outside. Thus, they are optimally protected against contamination and damage.

The latching elements serve to prevent the storage tray 4 from extending automatically relative to the support plate 3, which could occur if the storage tray 4 is not aligned exactly horizontally relative to the support plate 3. It would also be conceivable to adapt the curve geometry of the rolling element grooves.

As shown further in FIGS. 1 to 3, the latching elements are arranged in such a way that they engage with each other at the storage tray 4 at least in the initial position of the support plate 3, and that the latching elements engage even when the storage tray 4 is rotated by 180°.

Furthermore, according to the invention, it is possible to arrange the latching elements in such a way that the storage tray 4 is fixed in an arbitrarily pre-definable opening position with respect to the support plate 3, in particular at an opening angle of 90°, in order to enable advantageous loading and unloading of the storage tray 4.

FIGS. 10 to 13 show another embodiment variant in which the spherical caps 36 are separate components that can be clipped into receiving openings 38 of support plate 3. For this purpose, the spherical caps have expanding legs with hook-like ends protruding from the back of the spherical cap head, as shown in FIG. 11, in addition to the spherical cap head protruding from the bearing surface 31, as shown in

FIG. 10.

This allows the spherical caps 36 to be inserted from the bearing surface 31 into the receiving openings 38 of the support plate 3, with the hook-like ends gripping behind the edge of the receiving opening 38 from the underside, as shown in FIG. 12.

As shown in FIGS. 12 and 13, the raised edges of the beads 46, which are integrally molded onto the storage tray 4, are sloped in a ramp-like manner in pull-out direction A of the storage tray 4 towards the fastening receptacle 47 to facilitate penetration of the spherical caps 36 into the beads.

It is also conceivable to integrate a storage tray device as described above in other areas, for example in the glove compartment or trunk of a motor vehicle, in a warehouse or in cabinets such as the displays of a supermarket etc.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 Storage shelf
2 Base plate
3 Support plate
31 Bearing surface
32 Rolling element groove
33 Guide groove
34 Cam
341 Cam leg
342 Cam leg
35 Slot
36 Spherical cap
37 Underside
38 Receiving opening
4 Storage tray
41 Storage tray surface
42 Bearing surface
44 Rolling element groove
45 Pin
46 Bead
47 Fastening receptacle
48 Ramp
5 Base plate holder
6 Rolling element
7 Anti-tilting element
8 Fixing device
9 Rolling element cage
11 Piece of furniture
12 Household appliance
13 Carcass
14 Carcass
A Pull-out direction

The invention claimed is:

1. A storage shelf for a piece of furniture or household appliance, the storage shelf comprising:

a support plate arranged stationarily on a carcass of the piece of furniture or household appliance;

a storage tray, which is positively guided relative to the support plate and can simultaneously be moved both rotationally and translationally in a pull-out direction, wherein mutually facing bearing surfaces of the support plate and of the storage tray have respective at least predominantly closed, all-around rolling element grooves in which rolling elements are guided, wherein the bearing surfaces of the support plate and of the storage tray have respective shaped elements facing the respective other bearing surface, wherein the respective shaped elements, for the movement of the storage tray relative to the support plate from an initial position in a direction of a loading and unloading position, force an at least proportionate rotational movement of the storage tray, and wherein the respective shaped elements are pins projecting from one of the bearing surfaces of the support plate and of the storage tray, wherein the pins are positioned in the initial position of the tray in the pull-out direction behind cams, which project from the other of the bearing surfaces of the support plate and of the storage tray.

2. The storage shelf of claim 1, wherein the cams have two legs, wherein a first cam leg of the two legs is oriented in a plane of a first bearing surface of the bearing surfaces at an angle to a second cam leg of the two legs.

3. The storage shelf of claim 1, wherein the pins, in the initial position of the storage tray, project into guide grooves formed in the other of the bearing surfaces of the support plate and of the storage tray.

4. The storage shelf of claim 1, wherein the bearing surfaces of the support plate and the storage tray have respective latching elements facing the respective other bearing surface, wherein the respective latching elements engage in one another in the initial position of the support plate and the storage tray.

5. The storage shelf of claim 4, wherein the respective latching elements also engage in one another in the initial position of the support plate and the storage tray and when the support plate is rotated through 180°.

6. The storage shelf of claim 4, wherein the latching elements of the first of the bearing surfaces of the support plate and of the storage tray are spherical caps projecting the first of the bearing surfaces of the support plate and of the storage tray in a direction of the second of the bearing surfaces of the support plate and of the storage tray, and wherein the latching elements of the second of the bearing surfaces of the support plate and of the storage tray are beads.

7. The storage shelf of claim 4, wherein the latching elements are arranged between the bearing surfaces of the support plate and of the storage tray invisibly from outside of the storage shelf.

8. The storage shelf of claim 1, wherein the support plate is detachably held by at least one adapter on the carcass of the piece of furniture or household appliance.

9. The storage shelf of claim 8, wherein the storage shelf has a base plate, which is fixable to the carcass of the piece of furniture or household appliance by the adapter, which is a base plate holder, wherein the support plate rests on the base plate.

10. A piece of furniture, comprising:

a carcass; and at least one storage shelf mounted on the carcass, wherein the at least one storage shelf comprises a support plate arranged stationarily on the carcass of the piece of furniture or household appliance;

a storage tray, which is positively guided relative to the support plate and can simultaneously be moved both rotationally and translationally in a pull-out direction, wherein mutually facing bearing surfaces of the support plate and of the storage tray have respective at least predominantly closed, all-around rolling element grooves in which rolling elements are guided, wherein the bearing surfaces of the support plate and of the storage tray have respective shaped elements facing the respective other bearing surface, wherein the respective shaped elements, for the movement of the storage tray relative to the support plate from an initial position in a direction of a loading and unloading position, force an at least proportionate rotational movement of the storage tray, and wherein the respective shaped elements are pins projecting from one of the bearing surfaces of the support plate and of the storage tray, wherein the pins are positioned in the initial position of the tray in the pull-out direction behind cams, which project from the other of the bearing surfaces of the support plate and of the storage tray.

11. A refrigerator or freezer, comprising:

a carcass; and at least one storage shelf mounted on the carcass, wherein the at least one storage shelf comprises a support plate arranged stationarily on the carcass of the piece of furniture or household appliance;

a storage tray, which is positively guided relative to the support plate and can simultaneously be moved both rotationally and translationally in a pull-out direction, wherein mutually facing bearing surfaces of the support plate and of the storage tray have respective at least predominantly closed, all-around rolling element grooves in which rolling elements are guided, and wherein the bearing surfaces of the support plate and of the storage tray have respective shaped elements facing the respective other bearing surface, wherein the respective shaped elements, for the movement of the storage tray relative to the support plate from an initial position in a direction of a loading and unloading position, force an at least proportionate rotational movement of the storage tray, and wherein the respective shaped elements are pins projecting from one of the bearing surfaces of the support plate and of the storage tray, wherein the pins are positioned in the initial position of the tray in the pull-out direction behind cams, which project from the other of the bearing surfaces of the support plate and of the storage tray.

* * * * *